US011577887B2

(12) United States Patent
Tamarindo

(10) Patent No.: US 11,577,887 B2
(45) Date of Patent: Feb. 14, 2023

(54) CLOSURE WITH TAMPER-EVIDENT BAND

(71) Applicant: GUALA PACK S.P.A., Alessandria (IT)

(72) Inventor: Stefano Tamarindo, Alessandria (IT)

(73) Assignee: GUALA PACK S.P.A., Alessandria (IT)

( * ) Notice: Subject to any disclaimer, the term of this patent is extended or adjusted under 35 U.S.C. 154(b) by 239 days.

(21) Appl. No.: 16/320,917

(22) PCT Filed: Jul. 20, 2017

(86) PCT No.: PCT/IB2017/054397
§ 371 (c)(1),
(2) Date: Jan. 25, 2019

(87) PCT Pub. No.: WO2018/020365
PCT Pub. Date: Feb. 1, 2018

(65) Prior Publication Data

US 2019/0168924 A1 Jun. 6, 2019

(30) Foreign Application Priority Data

Jul. 29, 2016 (IT) ..... 102016000080146

(51) Int. Cl.
*B65D 41/34* (2006.01)
*B65D 55/02* (2006.01)
(Continued)

(52) U.S. Cl.
CPC ..... *B65D 41/3442* (2013.01); *B65D 47/122* (2013.01); *B65D 55/026* (2013.01);
(Continued)

(58) Field of Classification Search
CPC .. B65D 41/3442; B65D 47/122; B65D 47/12; B65D 55/026; B65D 75/5883;
(Continued)

(56) References Cited

U.S. PATENT DOCUMENTS 3,310,191 A * 3/1967 Kern ..... B65D 41/3419 215/252
4,402,418 A * 9/1983 Ostrowsky ..... B65D 41/3428 215/252
(Continued)

FOREIGN PATENT DOCUMENTS

CN 201201759 Y 3/2009
CN 201292070 Y 8/2009
(Continued)

OTHER PUBLICATIONS

International Search Report and Written Opinion of the International Searching Authority for International Patent Application No. PCT/IB2017/054397 dated Oct. 9, 2017, 10 pages.
(Continued)

*Primary Examiner* — Gideon R Weinerth
(74) *Attorney, Agent, or Firm* — Merchant & Gould P.C.

(57) ABSTRACT

A closure (8) with tamper-evident band (40) includes a fixed band (42, 142) and a movable body (50). The fixed band (42, 142), with tamper-evident band inviolate, is joined to the movable body (50) by a weakened portion (52, 152) The tamper-evident band (40) also includes a tamper-evident ring (70, 170) housed, with the tamper-evident band inviolate, in an inner compartment of the closure (8) to be hidden from view. The weakened portion (52, 152) tears due to the unscrewing of the closure (8) and the tamper-evident ring (70,170) pops out of the inner compartment and is arranged, with the seal violated, so as to separate a fixed edge (49, 149) of the fixed band (42, 142) from a movable edge (51, 151) of the movable body (50).

12 Claims, 13 Drawing Sheets

(51) Int. Cl.

| | |
|---|---|
| ***B65D 41/04*** | (2006.01) |
| ***B65D 51/18*** | (2006.01) |
| ***B65D 47/12*** | (2006.01) |
| ***B65D 75/00*** | (2006.01) |
| ***B65D 75/58*** | (2006.01) |

(52) U.S. Cl.
CPC ..... *B65D 75/5883* (2013.01); *B65D 2401/50* (2020.05); *B65D 2401/55* (2020.05); *B65D 2575/586* (2013.01)

(58) Field of Classification Search
CPC ..... B65D 75/008; B65D 2401/50; B65D 2401/55; B65D 2575/586; B65D 41/34; B65D 41/04; B65D 41/3428; B65D 41/3447; B65D 41/3438; B65D 41/3457; B65D 41/349; B65D 2401/30; B65D 2401/20; B65D 50/041
USPC ..... 215/252, 258, 253, 220, 901, 274; 383/80; 220/266, 276, 288
See application file for complete search history.

(56) References Cited

U.S. PATENT DOCUMENTS 4,470,513 A * 9/1984 Ostrowsky ..... B65D 41/3428 215/252
4,493,427 A 1/1985 Wolkonsky
4,530,437 A * 7/1985 Gray ..... B65D 41/3457 29/451
4,546,892 A * 10/1985 Couput ..... B65D 41/0414 215/253
4,550,844 A * 11/1985 Lininger ..... B65D 41/3428 215/252
4,669,124 A * 5/1987 Kimura ..... B65D 41/34 222/153.08
4,679,696 A * 7/1987 Bonnenfant ..... B65D 51/145 215/252
4,759,456 A * 7/1988 Kusz ..... B65D 41/3428 215/252
4,793,499 A * 12/1988 Dubach ..... B29C 45/006 29/451
4,805,791 A 2/1989 Begley
4,848,614 A * 7/1989 Csaszar ..... B65D 41/3428 220/268
5,076,453 A * 12/1991 Odet ..... B29C 45/2618 215/252
5,163,571 A * 11/1992 Morini ..... B65D 41/045 215/252
5,328,044 A * 7/1994 Rohrs ..... B65D 41/3438 215/252
5,346,082 A * 9/1994 Ochs ..... B65D 51/145 215/276
5,356,019 A * 10/1994 Kelly ..... B65D 41/3428 215/252
5,667,087 A * 9/1997 Delatour ..... B65D 41/48 215/258
5,819,965 A * 10/1998 King ..... B65D 41/3409 215/252
5,891,380 A * 4/1999 Larue ..... B65D 41/3428 264/296
5,971,182 A * 10/1999 Berge ..... B65D 41/3428 215/258
5,979,682 A * 11/1999 Zumbuhl ..... B65D 41/3428 215/252
6,325,227 B1 * 12/2001 Ekkert ..... B65D 41/3447 215/258
6,575,319 B2 * 6/2003 Zumbuhl ..... B65D 41/0421 215/252
6,604,643 B1 * 8/2003 Michael ..... E05B 73/0041 215/253
7,059,485 B1 * 6/2006 Reidenbach ..... B65D 41/3428 215/252
7,527,161 B2 * 5/2009 Rodriguez ..... B65D 41/3419 215/252
7,878,351 B2 * 2/2011 Falzoni ..... B65D 41/3428 220/276
8,251,236 B1 * 8/2012 Robinson ..... B65D 51/18 215/276
8,292,104 B2 * 10/2012 Cheng ..... B65D 41/325 215/256
8,684,203 B2 * 4/2014 Krautkramer ..... B65D 41/3428 215/252
9,016,524 B2 4/2015 Chisholm
9,533,802 B2 * 1/2017 Berge ..... B65D 75/008
9,938,050 B2 * 4/2018 Berge ..... B65D 47/122
10,214,325 B2 * 2/2019 Rognard ..... B65D 47/0852
10,486,867 B2 * 11/2019 Graybill ..... B65D 41/3423
10,934,063 B2 * 3/2021 Benoit-Gonin .... B65D 47/0852
11,312,555 B2 * 4/2022 Tamarindo ..... B65D 75/5883
2002/0096485 A1 * 7/2002 Zumbuhl ..... B65D 41/3428 215/252
2004/0026288 A1 * 2/2004 Zumbuhl ..... B65D 41/3428 206/459.1
2004/0060891 A1 * 4/2004 Nishida ..... B65D 41/3438 215/252
2005/0161425 A1 * 7/2005 Morini ..... B65D 41/3428 215/220
2007/0257002 A1 * 11/2007 Pucci ..... B65D 41/3428 215/252
2008/0135513 A1 * 6/2008 Umenaka ..... B65D 75/5883 383/204
2009/0223963 A1 * 9/2009 Bisio ..... B65D 41/3433 220/304
2010/0018942 A1 * 1/2010 Battegazzore ..... B65D 41/348 215/252
2013/0213923 A1 * 8/2013 Krautkramer ..... B65D 41/3428 215/252
2016/0257473 A1 * 9/2016 Bugenske ..... B65D 75/5883
2018/0170626 A1 * 6/2018 Kwon ..... B65D 41/3404
2018/0170628 A1 * 6/2018 Rognard ..... B65D 41/3457
2019/0168924 A1 * 6/2019 Tamarindo ..... B65D 47/122
2021/0039847 A1 * 2/2021 Umenaka ..... B65D 41/47

FOREIGN PATENT DOCUMENTS

| | | | |
|---|---|---|---|
| CN | 105246791 | A | 1/2016 |
| JP | 2001-055258 | A | 2/2001 |
| JP | 2014-019447 | A | 2/2014 |
| WO | 96/29257 | A1 | 9/1996 |
| WO | 2005/049443 | A1 | 6/2005 |
| WO | 2008/050361 | A1 | 5/2008 |
| WO | 2009/128095 | A1 | 10/2009 |
| WO | 2014/013361 | A1 | 1/2014 |
| WO | 2015/162128 | A2 | 10/2015 |

OTHER PUBLICATIONS

Chinese Office Action for corresponding Chinese Patent Application No. 201780045784.1 dated Oct. 8, 2019, 8 pages.
Chilean Office Action for corresponding Chilean Patent Application No. 201803802 dated Mar. 19, 2020, 16 pages.
Chinese Office Action for Chinese Patent Application No. 201780045784.1 dated Mar. 2, 2021, 8 pages.
Japanese Office Action for Japanese Patent Application No. 2019-504771 dated May 11, 2021, 13 pages.

* cited by examiner

CLOSURE WITH TAMPER-EVIDENT BAND

This application is a National Stage Application of PCT/IB2017/054397, filed 20 Jul. 2017, which claims the benefit of Ser. No. 102016000080146, filed 29 Jul. 2016 in Italy, and which applications are incorporated herein by reference. To the extent appropriate, a claim of priority is made to each of the above-disclosed applications.

BACKGROUND OF THE INVENTION

The present invention relates to a plastic closure provided with a tamper-evident band; in particular, the closure is associable with a spout, typically applied to a flexible packaging, usually intended to contain drinks for children, such as juices and fruit purees, yoghurt, soft drinks, etc.

As is known, most of the closures, especially if intended for food liquid containers, are provided with a tamper-evident seal, provided with weakened portions that, following the unscrewing of the closure from the spout, break, thus highlighting the fact that the container has already been opened.

For example, the Applicant is the owner of the patent family of the international application WO-A1-2008/050361.

Sometimes, however, the user pays little attention to the actual conditions of the seal or the weakened portions are little evident and appear to be broken only after a thorough check.

SUMMARY OF THE INVENTION

The object of the present invention is to overcome the drawbacks mentioned with reference to the prior art by providing a closure for a spout provided with a tamper-evident seal for which the condition of breakage is particularly evident.

BRIEF DESCRIPTION OF THE DRAWINGS

The features and the advantages of the closure according to the present invention will appear more clearly from the following description, made by way of an indicative and non-limiting example with reference to the following figures, in which.

DETAILED DESCRIPTION OF THE PREFERRED EMBODIMENT

Figure 1:
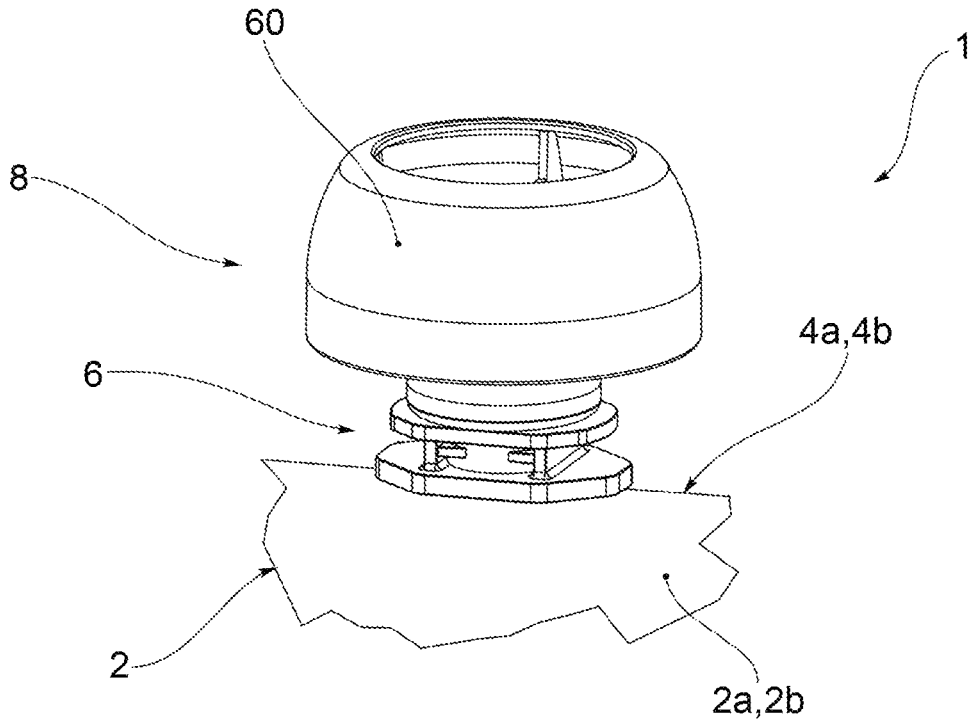
FIG. 1 shows a closure according to an embodiment of the present invention, applied to the spout of a flexible packaging, in an inviolate seal configuration.

With reference to the accompanying figures, reference numeral 1 indicates as a whole a packaging for containing a substance, in particular for containing a food liquid.

Packaging 1 comprises a packaging body 2 preferably consisting of film walls.

For example, the packaging body 2 consists of a pair of facing side walls 2*a*, 2*b*, joined along a respective upper edge 4*a*, 4*b*, for example by welding.

According to an embodiment, the side walls 2*a*, 2*b* are joined together, for example by welding, along all the peripheral edges; in alternative embodiments, the packaging body instead comprises a bottom wall and/or one or two side walls, thus forming gussetted bags.

Packaging 1 further comprises a spout 6, applied to the packaging body 2, and a closure 8 applicable to spout 6 to close it.

Spout 6 comprises tubular body 10 that extends along a rectilinear main axis X, for example coincident with the central axis of the inner cylindrical side wall, between an entry end 12 and a dispensing end 14.

According to an embodiment, spout 6 comprises a connection portion 16, in correspondence of the entry end 12 of the tubular body 10, for the sealed connection with the packaging body 2.

In particular, the connection portion 16 has connection faces 18*a*, 18*b* on opposite sides with respect to the main axis X, intended for the application of portions of the upper edges 4*a*, 4*b* of the side walls 2*a*, 2*b*.

From the entry end 12 towards the dispensing end 14, spout 6 also comprises a first plate 20, adjacent to the connection portion 16, and a second plate 22, axially spaced from the first plate 20, substantially parallel to the latter.

Said plates 20, 22 have a prevailing extension of imaginary planes substantially perpendicular to the main axis X.

Spout 6 further comprises a main abutment 24, for example made in the form of a ring, continuous or in separate sectors, axially spaced from the second plate 22.

Preferably, the main abutment 24 has a frusto-conical side surface 26, tapered towards the entry end of the tubular body 10, and is flanked by a main annular recess 28, undercut with respect to abutment 24.

Finally, spout 6 comprises a thread 30 external to the tubular body 10, for screwing closure 8. [00*ei*] According to the invention, closure 8 comprises a tamper-evident band 40.

Figure 2:
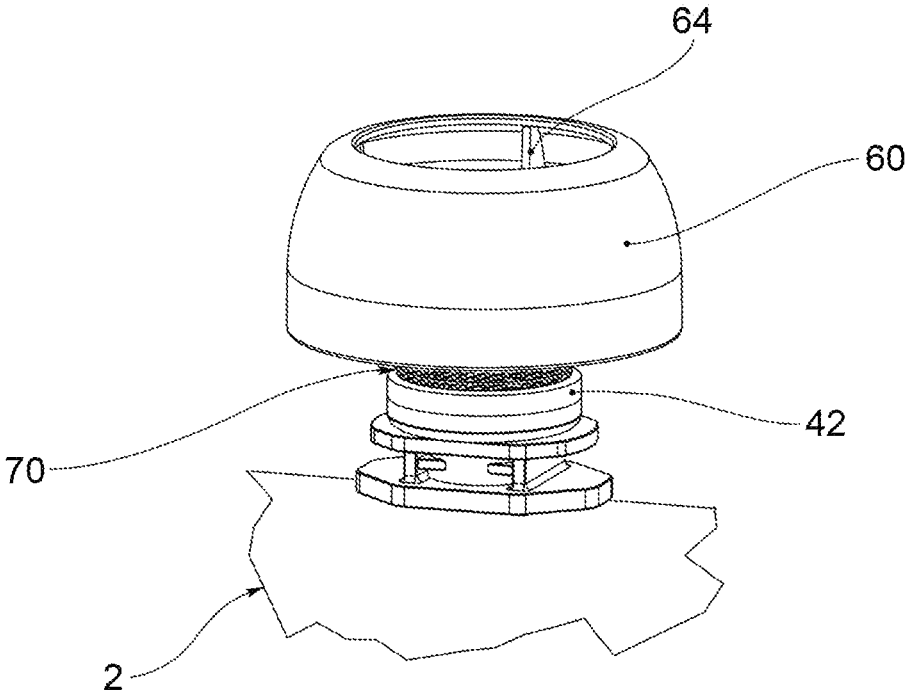
FIG. 2 shows the closure in FIG. 1 in a violate seal configuration.
Figure 3:
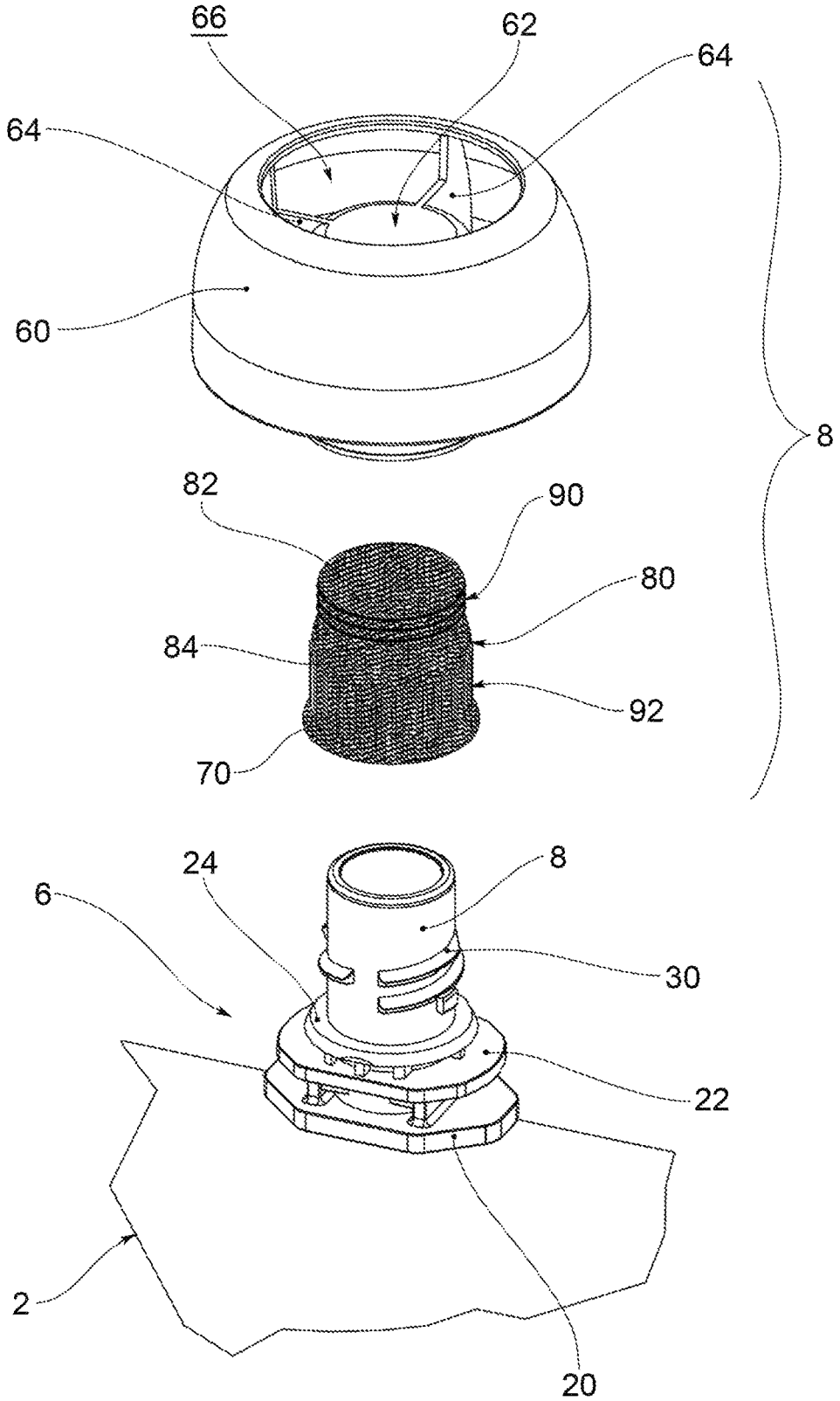
FIG. 3 shows the closure in FIG. 1 in separate parts.
Figure 4:
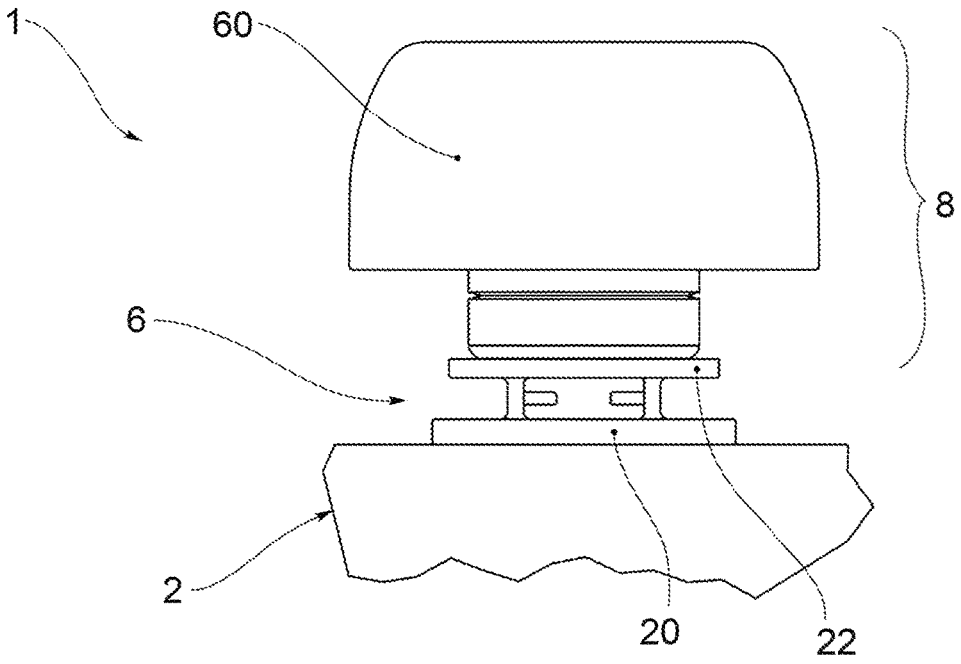
FIG. 4 shows a side view of the closure in FIG. 1 (in an inviolate seal configuration)
Figure 5:
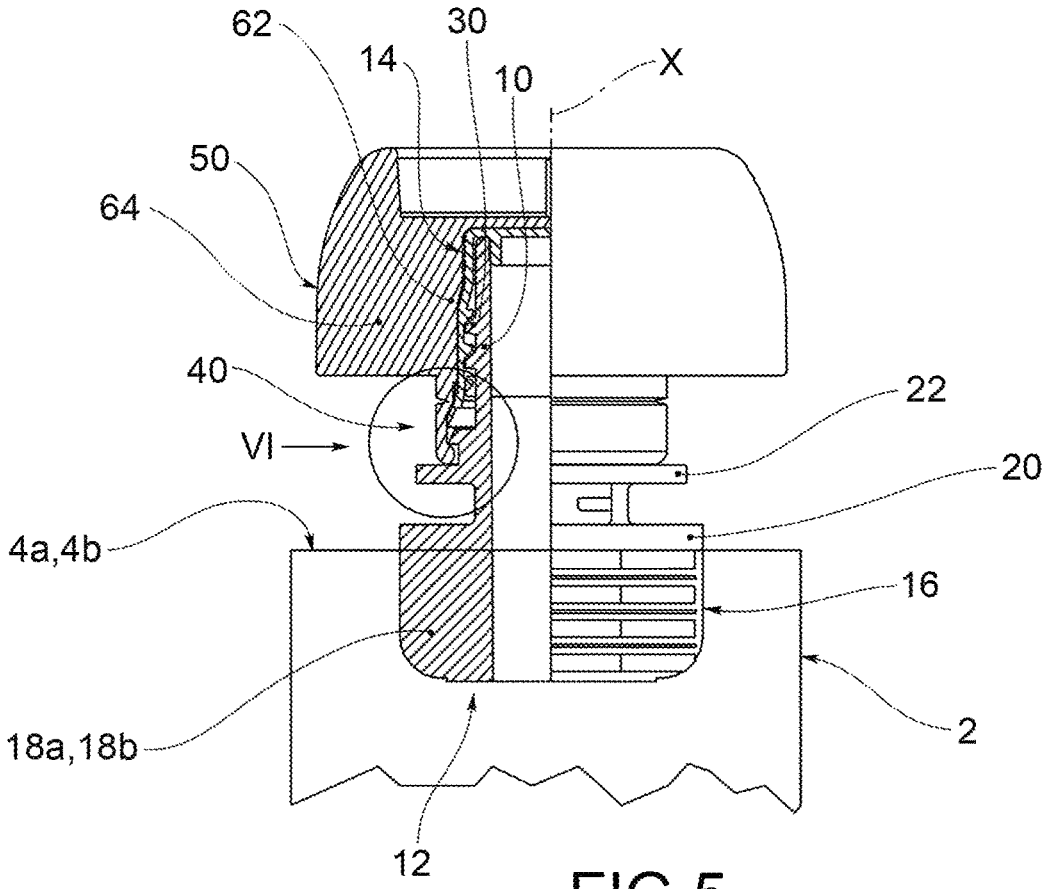
FIG. 5 shows a sectional view of the closure in FIG. 1 (in an inviolate seal configuration)
Figure 6:
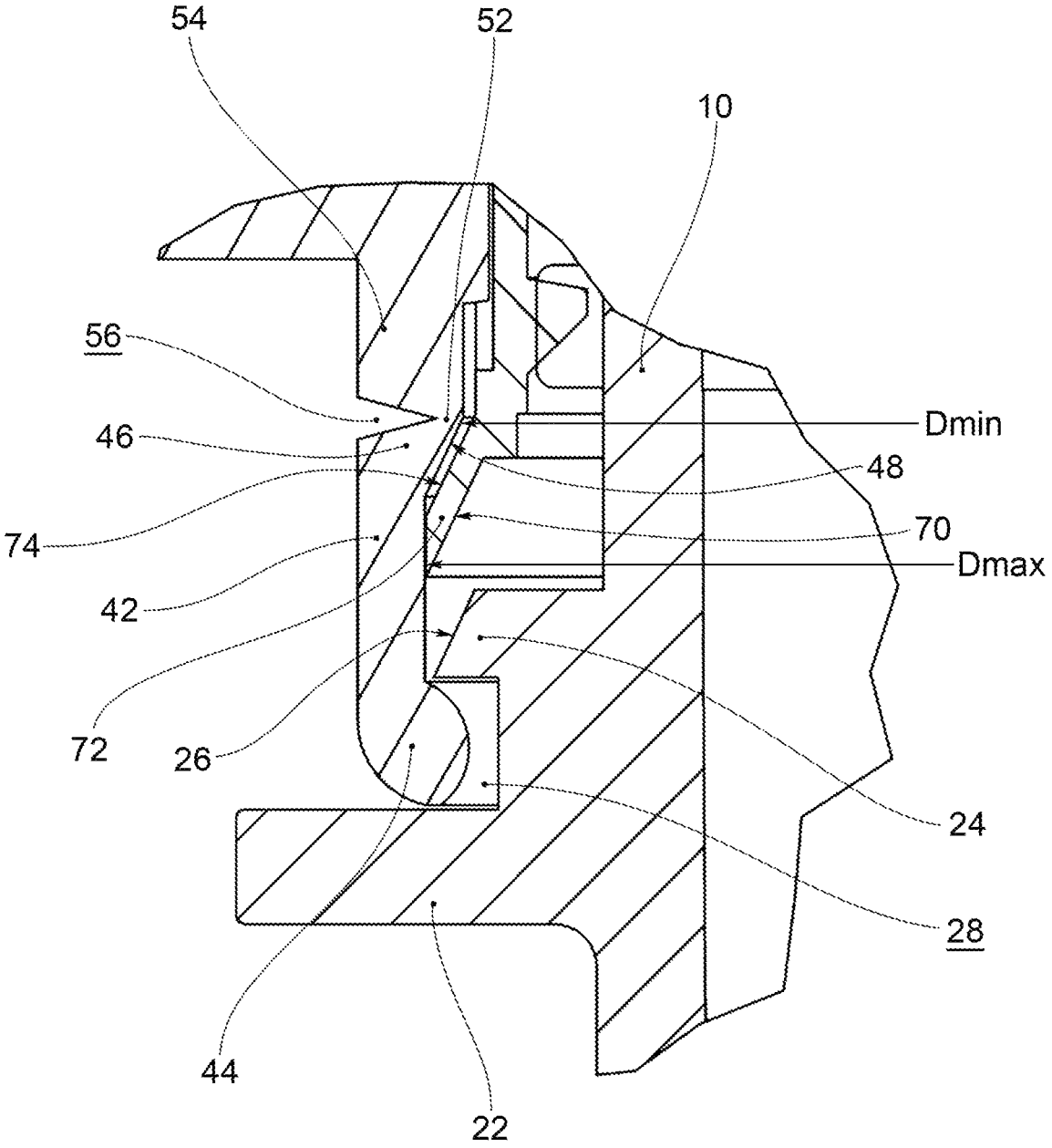
FIG. 6 shows an enlargement of detail VI in FIG. 5 (in an inviolate seal configuration)
Figure 8:
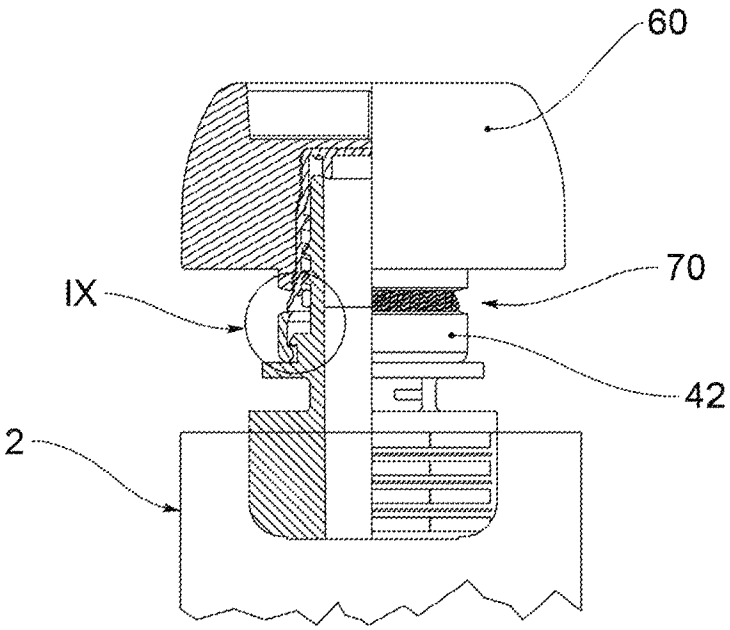
FIG. 8 shows a sectional view of the closure in FIG. 2 (in a violate seal configuration)
Figure 9:
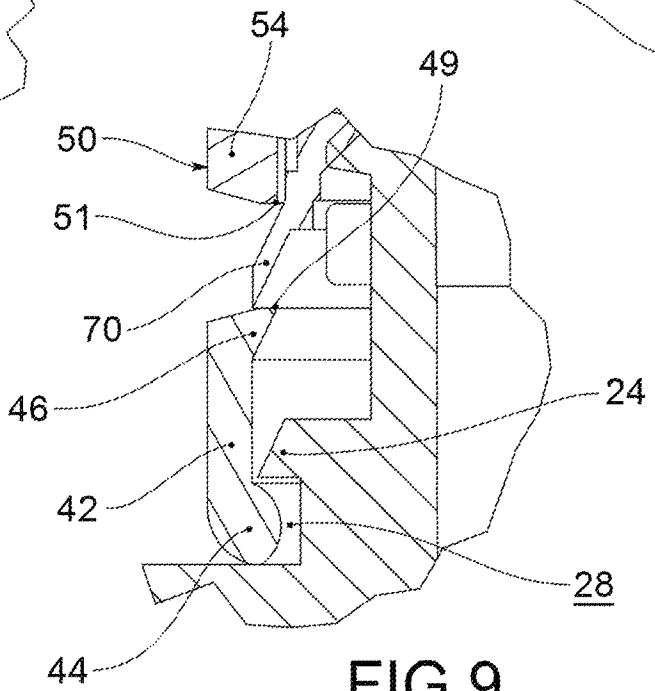
FIG. 9 shows an enlargement of detail IX in FIG. 8 (in a violate seal configuration)
Figure 7:
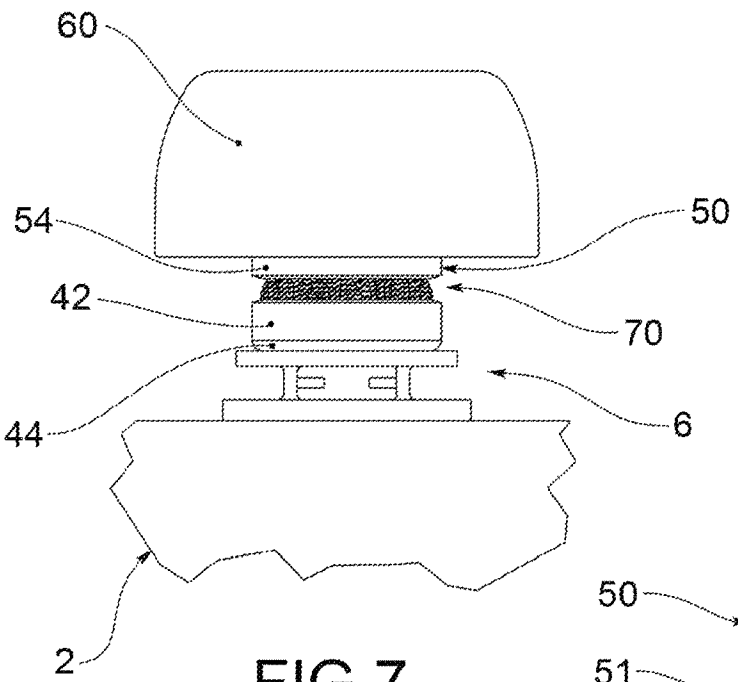
FIG. 7 shows a side view of the closure in FIG. 2 (in a violate seal configuration)

According to a preferred embodiment (FIGS. 1 to 9), the tamper-evident band 40 comprises a fixed annular band 42 directly engageable by the main abutment 24 of spout 6 so that the axial translation thereof is prevented.

For example, according to an embodiment variant, the fixed band 42 has a free end 44 bent radially internally or enlarged with respect to the remaining part, so that it is at least partially received in the main recess 28.

At the other end, the fixed band 42 has a flared wall 46 internally having an annular frusto-conical side surface 48 converging in the unscrewing direction of closure 8 from spout 6.

Closure 8 further comprises a movable body 50 which, during the unscrewing from spout 6, undergoes an axial translation that separates it from the spout itself.

When the tamper-evident band is inviolate, the movable body 50 is connected to the fixed band 42 through a weakened portion 52 of the tamper-evident band 40, in which an annular fixed edge 49 of the fixed band 42 and a movable edge 51 of the movable body 50 are joined.

For example, the tamper-evident band 40 comprises a cylindrical shank 54 of the movable body 50, joined to the fixed band 42 through the weakened portion 52; said weakened portion 52 is formed as a portion of reduced diameter by virtue of a radial notch 56 made externally.

Preferably, moreover, the movable body 50 comprises a handle 60 adapted to be grasped by a hand to perform the unscrewing of the closure, and an inner casing 62, from which said shank 54 projects axially, joined to handle 60 through a plurality of angularly spaced fins 64, between which passages 66 are formed between the inner casing 62 and handle 60, generally for anti-choking purpose.

The tamper-evident band 40 further comprises a tamper-evident ring 70 which, with the tamper-evident band inviolate, is housed in the compartment delimited by the fixed band 42 and is therefore hidden from view.

The tamper-evident ring 70 is made integral with the movable body 50 of closure 8, so that by unscrewing the latter, it undergoes an axial translation that makes it slip off from the spout.

Moreover, the tamper-evident ring 70 externally has a maximum diameter Dmax greater than the minimum diameter Dmin of the side surface 48 of the flared wall 46 of the fixed band 42, so that during the axial translation due to the unscrewing, it can pop out of the fixed band 42.

In particular, the tamper-evident ring 70 comprises a tamper-evident wall 72 having a frusto-conical outer surface 74, converging in the direction of translation of the movable body 50 during the unscrewing, for example parallel to the side surface 48 of the flared wall 46 of the fixed band 42.

According to an embodiment variant, closure 8 comprises a cap 80 having a bottom 82 and an annular cap wall 84, having an axial extension.

Bottom 82 preferably forms the closure for the mouth of the tubular body 10 of spout 6, while the end projection of the cap wall 84 forms said tamper-evident ring 70.

Moreover, the cap wall 84 internally has a thread for screwing with thread 30 of spout 6.

Cap 80 is made integral in translation and rotation to the movable body 50 of closure 8.

In particular, cap 80 is at least partially received in casing 62 of the movable body 50, so that the tamper-evident ring body 70 is still housed inside the compartment delimited by the fixed band 43.

In order to axially lock cap 80 to the movable body 50, said cap 80 is provided, for example on the outer surface of the cap wall 84, for example proximate to bottom 82, with a plurality of circumferential grooves 90, in which respective circumferential projections provided in casing 62 of the movable body 50 are snap-received.

In order to lock cap 80 in rotation to the movable body 50, said cap 80 is provided, for example on the outer surface of the cap wall 84, for example adjacent to the tamper-evident ring 70, with a plurality of axial grooves 92, in which respective axial projections provided in casing 62 of the movable body 50 are snap-received.

Cap 80 is made in a single piece, for example by injection moulding, of plastic material.

Likewise, the group consisting of the movable body 50 and the fixed band 42 is made in a single piece, for example by injection moulding, of plastic material.

Finally, the spout is made in a single piece, for example by injection moulding, of plastic material.

Once the movable body—fixed band 42 group and cap 80 have been made, the cap is inserted into the inner casing 62 of the movable body 50, thus achieving the complete closure 8.

Once spout 6 has been sealably applied to packaging 2, the filling with the liquid is typically carried out through spout 6 and finally closure 8 is applied.

During the application, the closure is screwed to the tubular body 10 of spout 6 and during such screwing, the free ends 44 of the fixed band 42 snaps into the main recess 28, due to the flared profile of the side surface 26 of abutment 24.

At the first opening of packaging 1 (FIGS. 2 and 7 to 9), the unscrewing of closure 8 makes the movable body translate in the direction of extraction from the tubular body 10 of spout 6.

The fixed band 42 is urged to translate in the same direction, since it is initially integral with the movable body, but it is prevented from translating by the engagement between the free end 44 and the main abutment 24 of spout 6.

The weakened portion 52 thus undergoes a rupture, which makes the movable body 50 separate axially from the fixed band 42.

The axial translation of the movable body 50 drags in translation the tamper-evident ring 70 integral with said movable body 50, so that said ring 70, by cooperating with the flared wall 46 of the fixed band 42, snaps out of the compartment delimited by the fixed band 42, thus becoming visible from the outside.

In particular, the tamper-evident ring 70 first undergoes a deformation which makes it narrow and then, popped out of the fixed band, an elastic return to an undeformed condition.

For this reason, at the next screwing of the movable body to the spout, the tamper-evident ring 70 is prevented from returning into the fixed band, arranging itself in a clear manner between the fixed edge 49 and the movable edge 51, separate and axially spaced apart. The violation of the seal is thus evident.

Preferably, moreover, the colour of the tamper-evident ring 70, selected so as to stand out with respect to the colour of the fixed band 42 and the movable body 50, contributes to make the tamper-evident ring more evident.

In other words, according to the embodiment described above, the tamper-evident ring 70 is integral in translation with the movable body 50 of closure 8.

Figure 10:
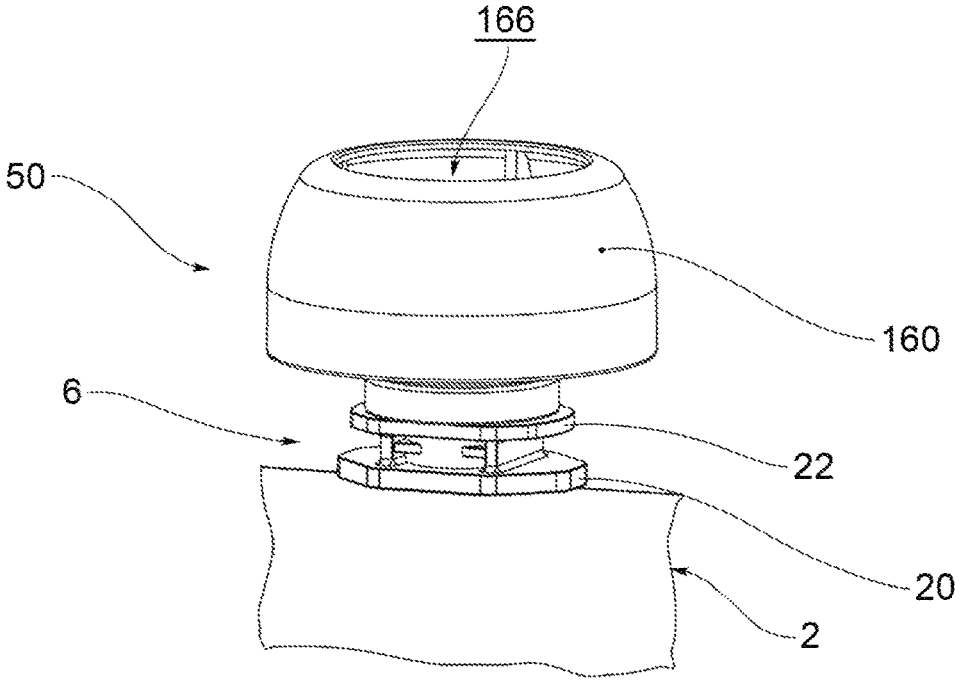
FIG. 10 shows a closure according to a further embodiment of the present invention, applied to the spout of a flexible packaging, in an inviolate seal configuration.
Figure 11:
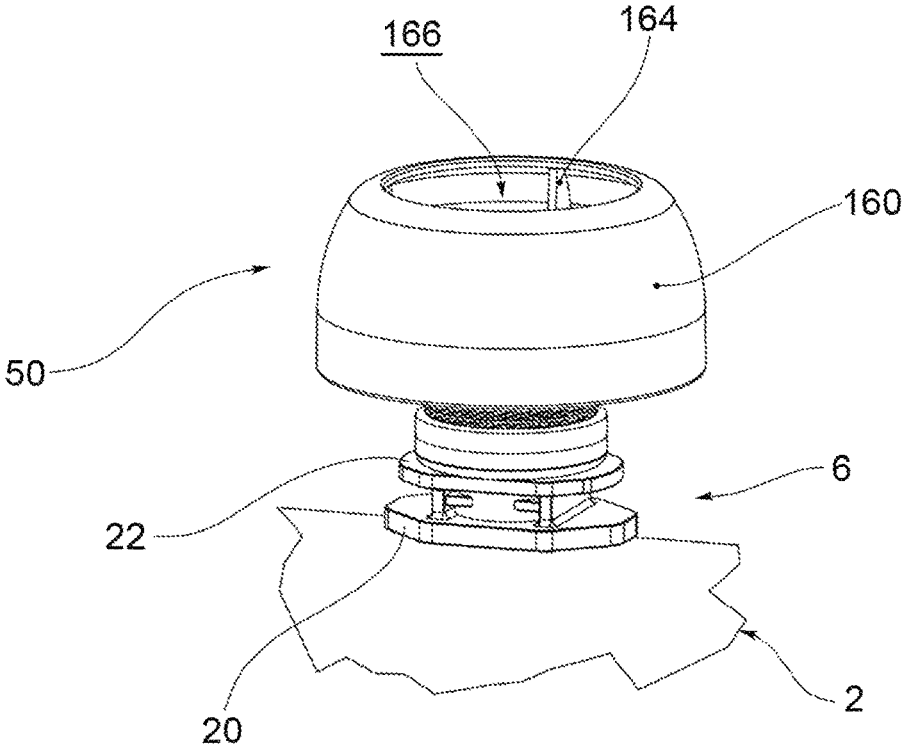
FIG. 11 shows the closure in FIG. 10 in a violate seal configuration.
Figure 12:
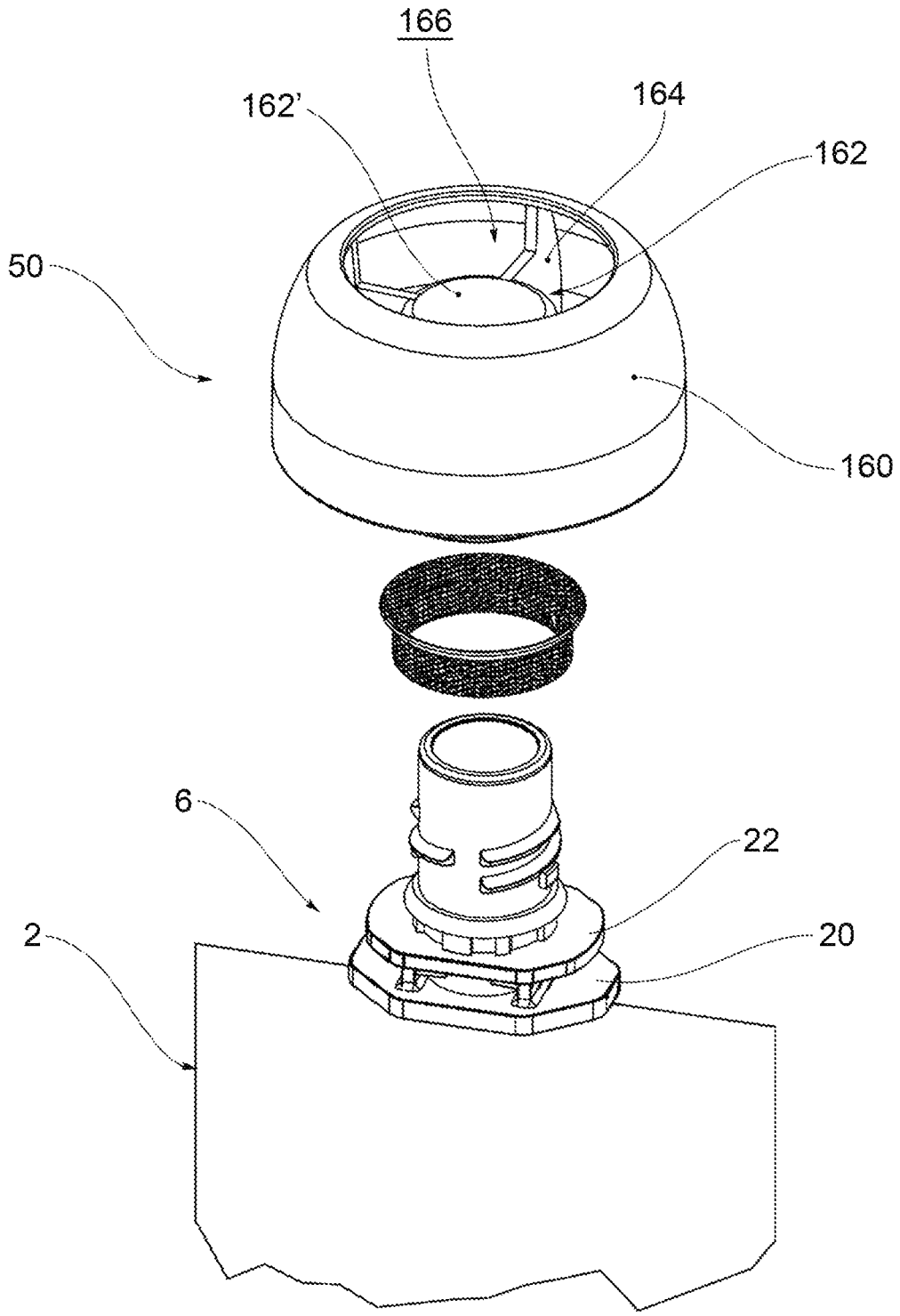
FIG. 12 shows the closure in FIG. 10 in separate parts.
Figure 14:
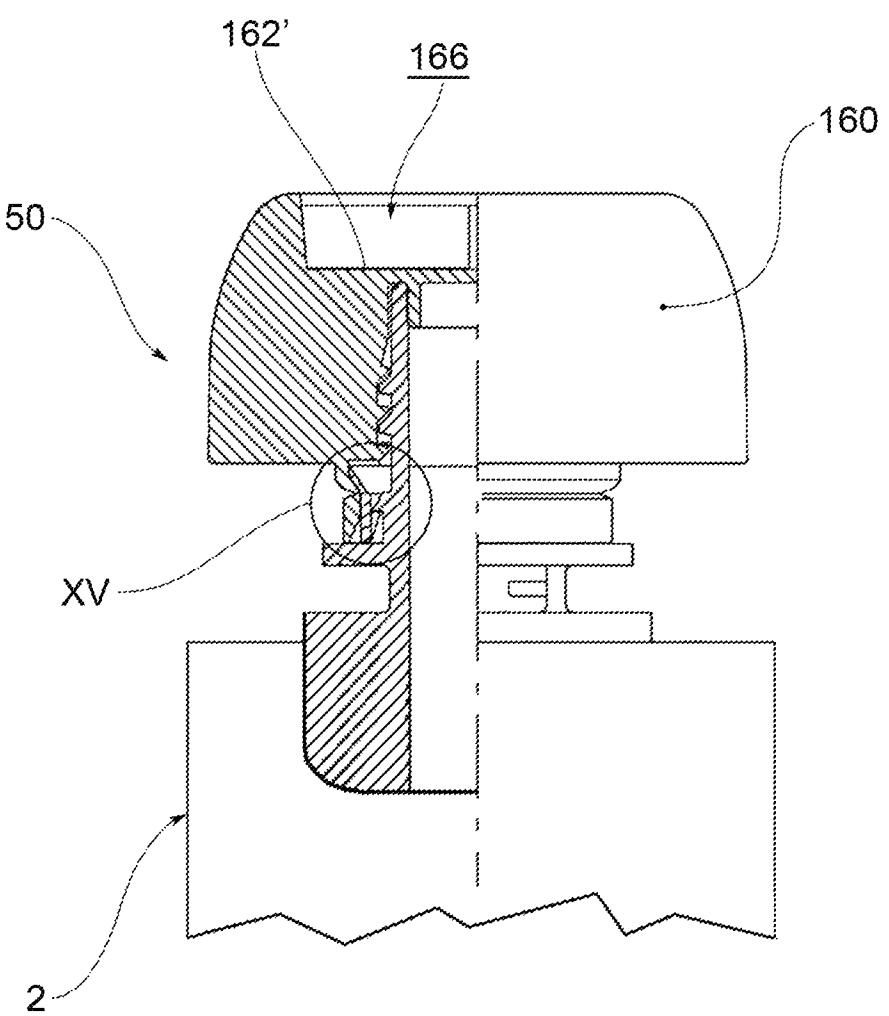
FIG. 14 shows a sectional view of the closure in FIG. 10 (in an inviolate seal configuration)
Figure 13:
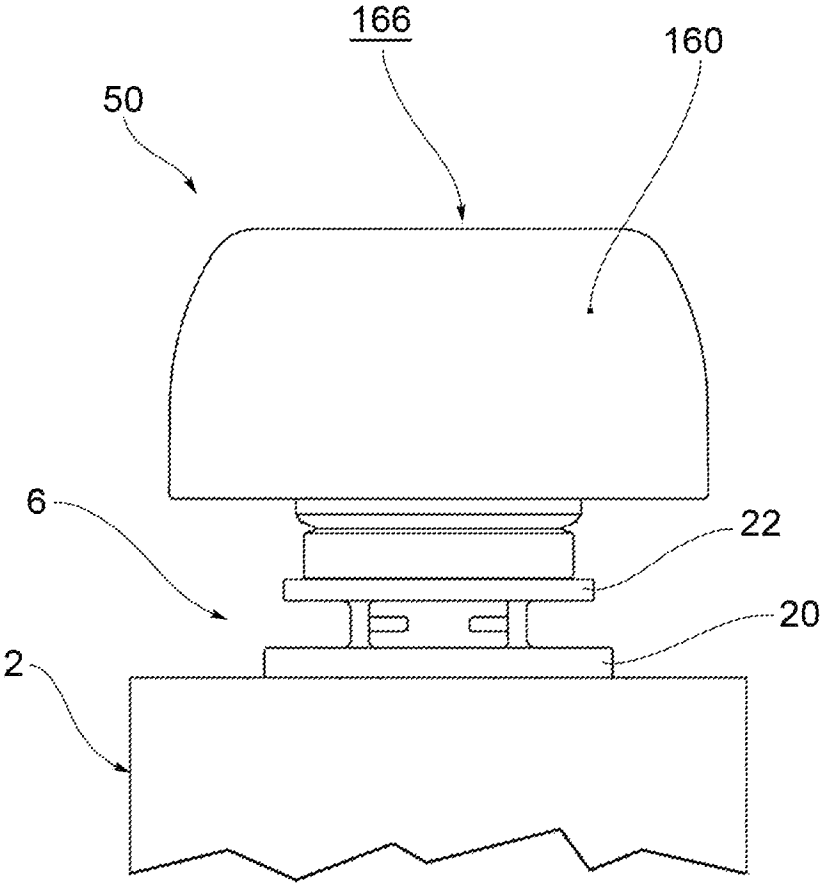
FIG. 13 shows a side view of the closure in FIG. 10 (in an inviolate seal configuration)
Figure 15:
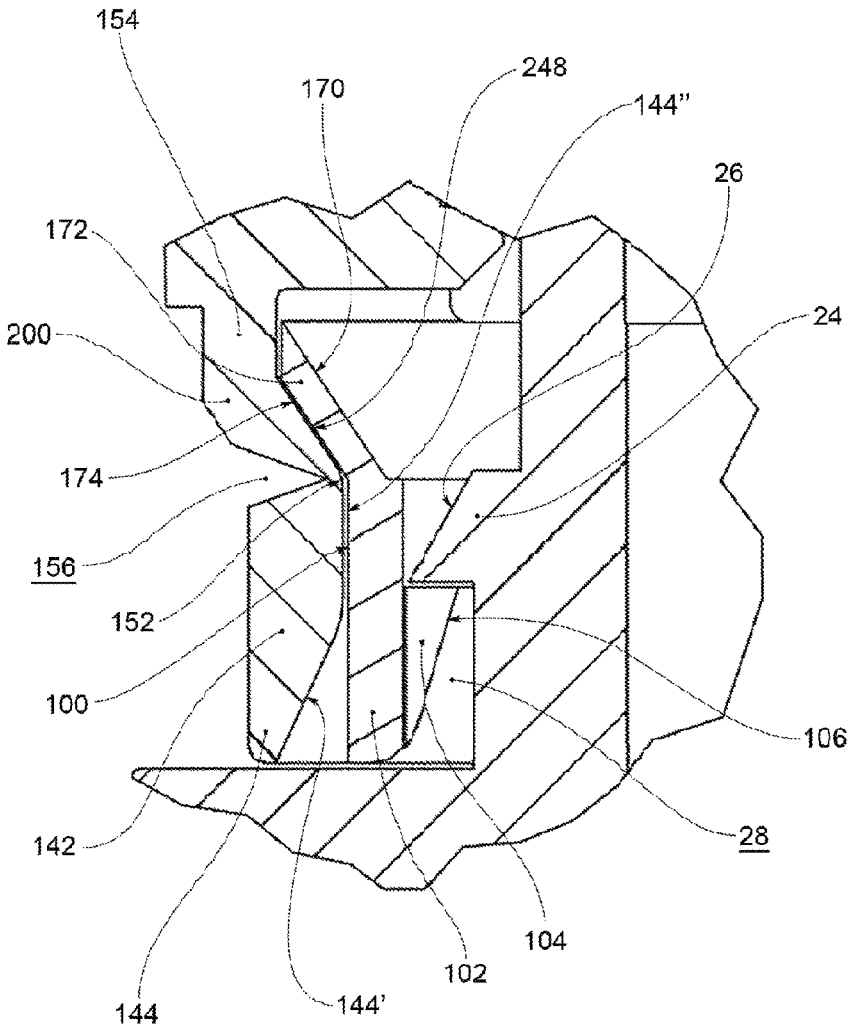
FIG. 15 shows an enlargement of detail XV in figure (in an inviolate seal configuration)
Figure 17:
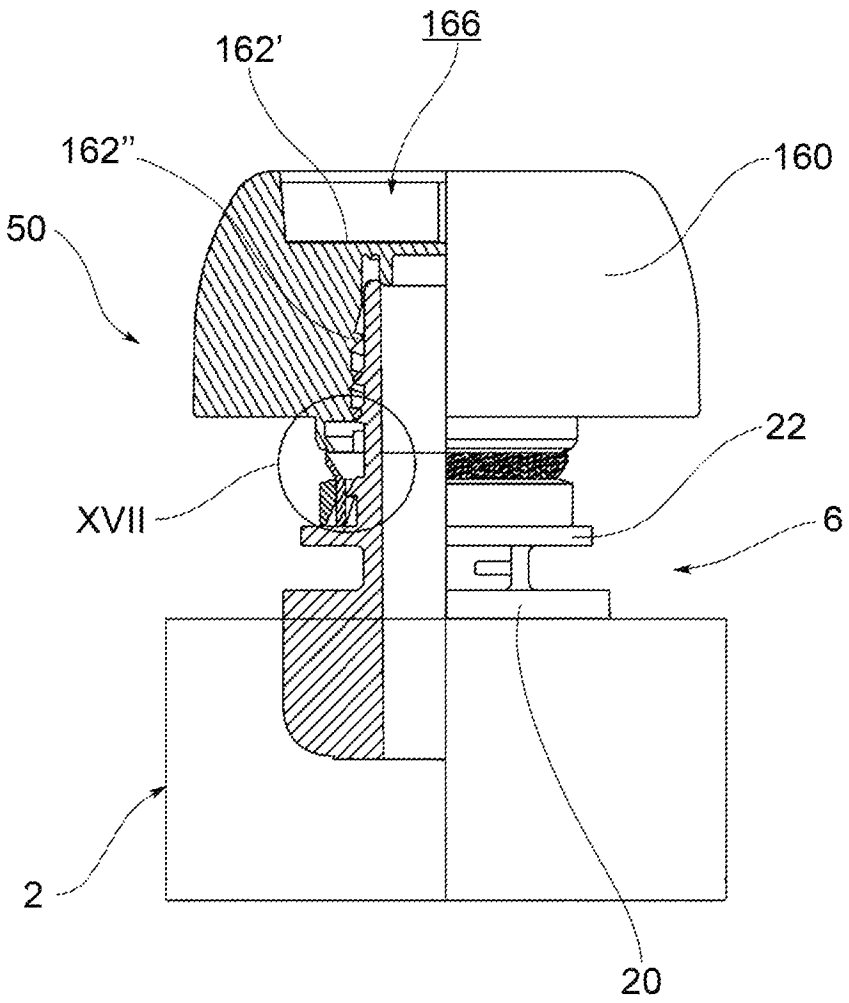
FIG. 17 shows a sectional view of the closure in FIG. 11 (in a violate seal configuration)
Figure 16:
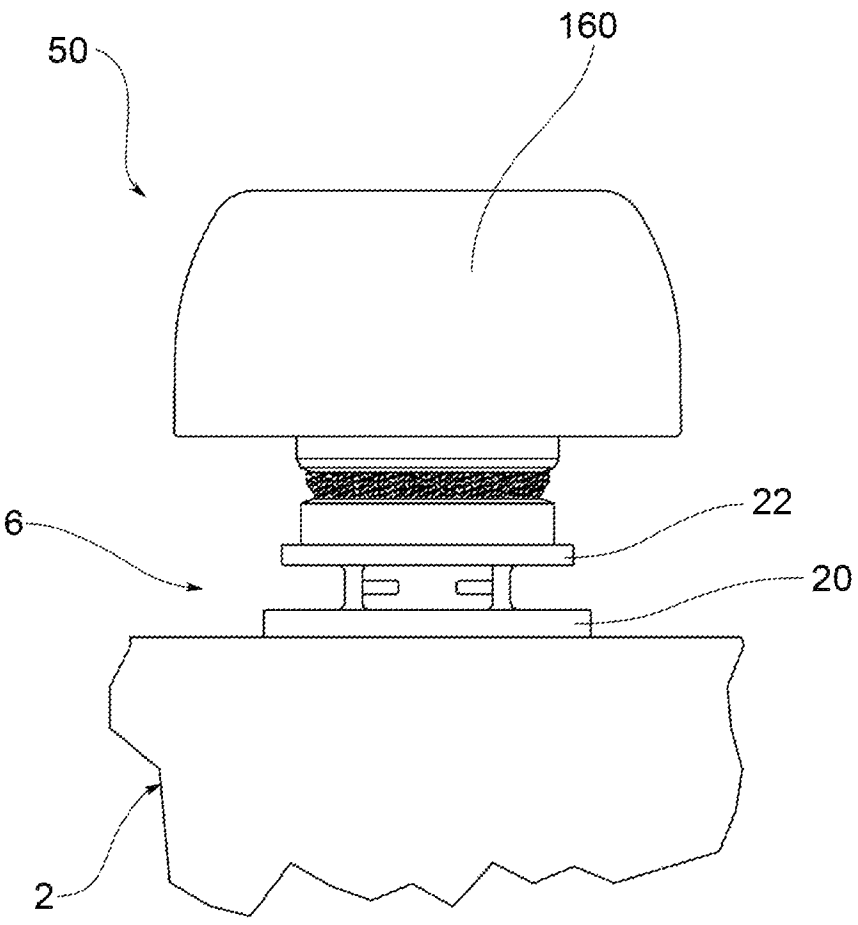
FIG. 16 shows a side view of the closure in FIG. 11 (in a violate seal configuration)
Figure 18:
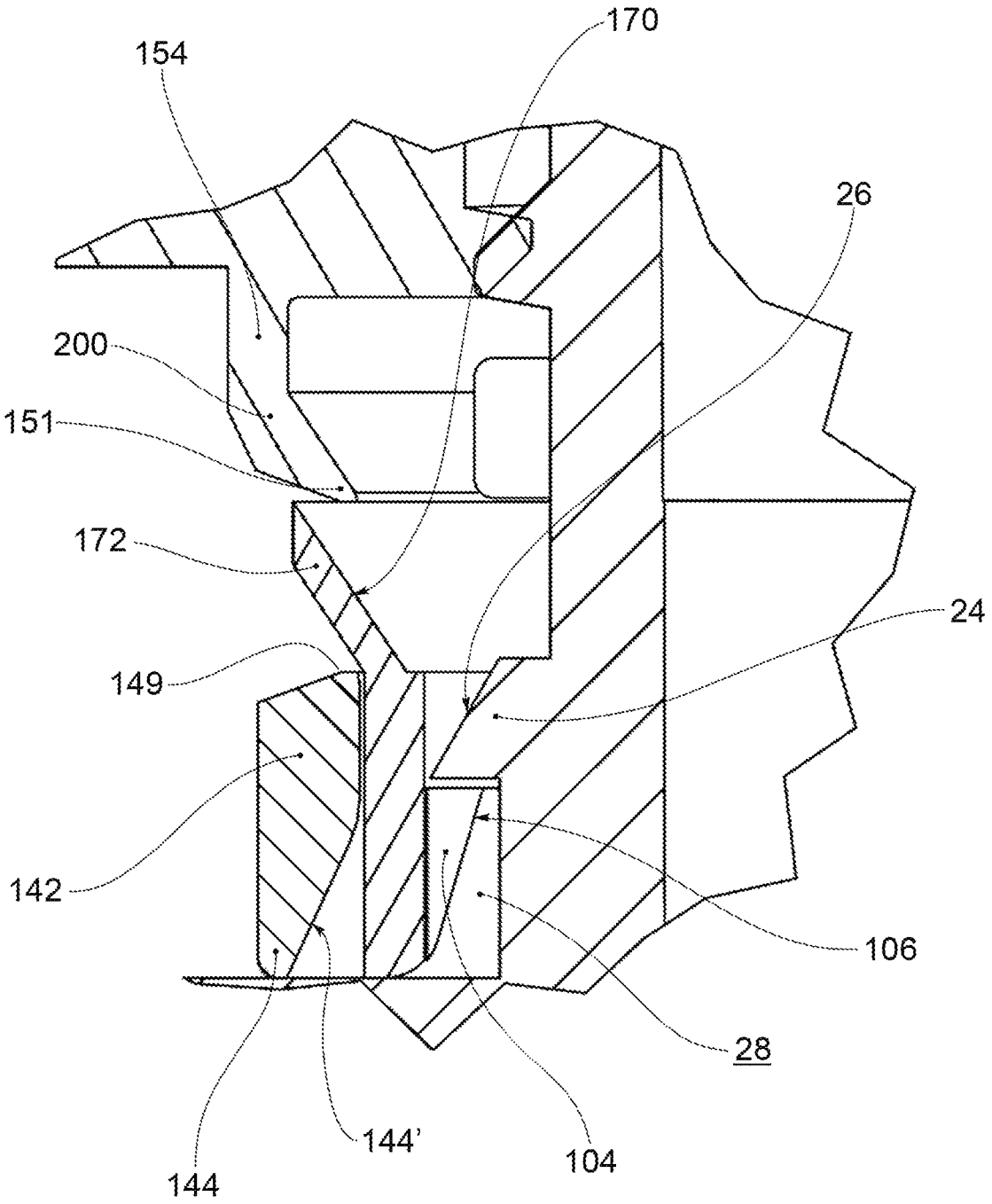
FIG. 18 shows an enlargement of detail XVIII in FIG. 17 (in a violate seal configuration)

According to a further embodiment (FIGS. 10 to 18), the tamper-evident band 40 instead comprises a tamper-evident bushing 100, in turn comprising a tamper-evident ring 170, which remains fixed to the spout during the translation of a movable body 50 of closure 8 during the unscrewing.

In particular, according to an embodiment variant, the tamper-evident bushing 100 comprises an annular base wall 102, which extends around the tubular body 10 of spout 6, and an annular engagement tooth 104, circumferentially continuous or divided into sectors, protruding radially internally from the base wall 102, so as to achieve a coupling with the main abutment 24 of spout 6; the axial translation of the tamper-evident bushing 100, in the unscrewing direction, is thus prevented or limited.

In particular, the engagement tooth 104 has a frusto-conical side surface 106 converging in the unscrewing translation direction of the movable body 50, so as to form a snap engagement with the main abutment 24, thus housing at least partially in the main recess 28.

The tamper-evident bushing 100 further comprises said tamper-evident ring 170, projecting axially and radially outwardly from the base wall 102.

According to an embodiment variant, the tamper-evident ring 170 comprises a tamper-evident wall 172 having a frusto-conical outer surface 174, diverging in the unscrewing translation direction of the movable body 50.

The movable body 50 of closure 8, which during the unscrewing from spout 6 undergoes an axial translation that makes it separate from the spout itself, comprises an annular shank 154, which extends around the tubular body 10 of spout 6.

The tamper-evident band 40 comprises a movable band 200 integral with the movable body 50, for example protruding axially from shank 154, and an annular fixed band 142, which extends around the tubular body 10 of spout 6.

When the tamper-evident band 40 is inviolate, the fixed band 142 and the movable band 200 are joined together through a weakened portion 152, in which an annular fixed edge 149 of the fixed band 142 and a movable edge 151 of the movable body 200 are joined.

For example, the weakened portion 152 is formed as a reduced diameter portion by virtue of an annular radial notch 156 externally formed between the movable band 100 and the fixed band 142.

The movable band 200 and the fixed band 142 are radially outwardly spaced from the tubular body 10 of spout 6, annularly delimiting a compartment in which the tamper-evident bushing 100 is housed.

In particular, the base wall 102 of bushing 100 is arranged radially between the fixed band 142 and the main abutment 24 of the tubular body 10, while the tamper-evident ring 170 is arranged radially between the movable band 200 and said tubular body 10.

Moreover, the tamper-evident ring 170 protrudes radially outwardly with respect to the weakened portion 152 that joins the movable band 200 and the fixed band 142, so as to form an obstacle which limits the axial translation in the unscrewing direction of said fixed band 142.

Moreover, the tamper-evident ring 170 is anchored to the tubular body 10 through the engagement tooth 104 engaged with the main abutment 24, whereby the fixed band 142 is indirectly constrained to the tubular body 10 and substantially prevented from the axial translation for unscrewing.

The movable band 200 internally has a frusto-conical side surface 248 diverging in the unscrewing direction of the movable body 50 from spout 6.

The tamper-evident ring 170 cooperates with the movable band 200 through said side surface 248, into contact with the outer surface 174 of the tamper-evident ring 170.

According to an embodiment variant, the fixed band 142 and the movable band 200 internally have a profile comprising:

a frusto-conical guiding surface 144' of the fixed band 142, arranged at the mouth of the fixed band 142;

preferably, a spacer surface 144" of the fixed band 142, preferably cylindrical, axially flanked inwardly to the guiding surface 144';

said frusto-conical side surface 248 of the movable band 200, flanked to the spacer surface 144" (or, in an alternative embodiment, directly to the guiding surface 144').

According to an embodiment variant, the movable body 50 comprises a handle 160 adapted to be grasped by a hand to perform the unscrewing of the closure, and an inner casing 162, from which the movable band 200 projects axially, joined to handle 160 through a plurality of angularly spaced fins 164, between which passages 166 are formed between the inner casing 162 and handle 160, generally for anti-choking purpose.

Preferably, casing 162 is provided with a bottom 162', which forms the closure for the mouth of the tubular body 10 of spout 6, and an inner thread 162" for screwing to said tubular body 10.

The tamper-evident bushing 170 is made in a single piece, for example by injection moulding, of plastic material.

Likewise, the group consisting of the movable body 50, the movable band 200 and the fixed band 142 is made in a single piece, for example by injection moulding, of plastic material.

Finally, the spout is made in a single piece, for example by injection moulding, of plastic material.

Once the movable body—movable band—fixed band 50, 200, 142 group and the tamper-evident bushing 170 have been made, bushing 170 is inserted into the movable band 200 and the fixed band 142, thus achieving the complete closure 8.

To this end, the guiding surface 144' of the fixed band 142 allows the insertion of bushing 100 from the side of the tamper-evident ring 170, so that said ring 170 first shrinks, and then widens in the compartment defined by the movable band 200.

Once spout 6 has been sealably applied to packaging 2, the filling with the liquid is typically carried out through spout 6 and finally closure 8 is applied.

During the application, the closure is screwed to the tubular body 10 of spout 6 and during such screwing, the free ends 44 of the fixed band 42 snaps into the main recess 28, due to the flared profile of the side surface 26 of abutment 24.

At the first opening of packaging 1 (FIGS. 11 and 16 to 18), the unscrewing of closure 8 makes the movable body 50 translate in the direction of extraction from the tubular body 10 of spout 6.

The fixed band 142 is urged to translate in the same direction, since it is initially integral with the movable body 50 through the weakened portion 142, but it is prevented from translating by the anchoring to the main abutment 24 through bushing 170.

The weakened portion 152 thus undergoes a rupture, which makes the movable body 50 separate axially from the fixed band 142.

The movable body 50 in translation drags the movable band 200 therewith, so that the tamper-evident ring 170, by cooperating with the side surface 248 of the movable band 200, snaps out of the movable band 200, thus becoming visible from the outside.

In particular, the tamper-evident ring 170 first undergoes a deformation which makes it shrink and then, popped out of the movable band, an elastic return to an undeformed condition.

For this reason, at the next screwing of the movable body to the spout, the tamper-evident ring 170 is prevented from returning into the movable band, arranging itself in a clear manner between the fixed edge 149 of the fixed band 142 and the movable edge 151 of the movable band 200, separate and axially spaced apart. The violation of the seal is thus evident.

Preferably, moreover, the colour of the tamper-evident ring 170, selected so as to stand out with respect to the colour of the fixed band 142 and the movable body 50, contributes to make the tamper-evident ring more evident.

Figure 19:
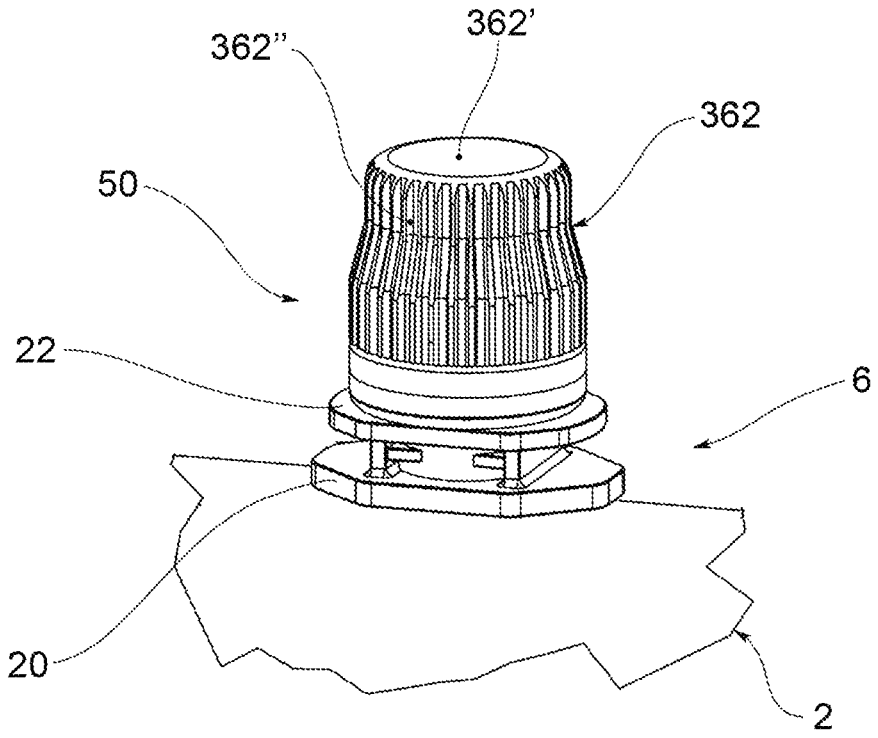
FIG. 19 shows a closure according to an even further embodiment of the present invention, applied to the spout of a flexible packaging, in an inviolate seal configuration.
Figure 20:
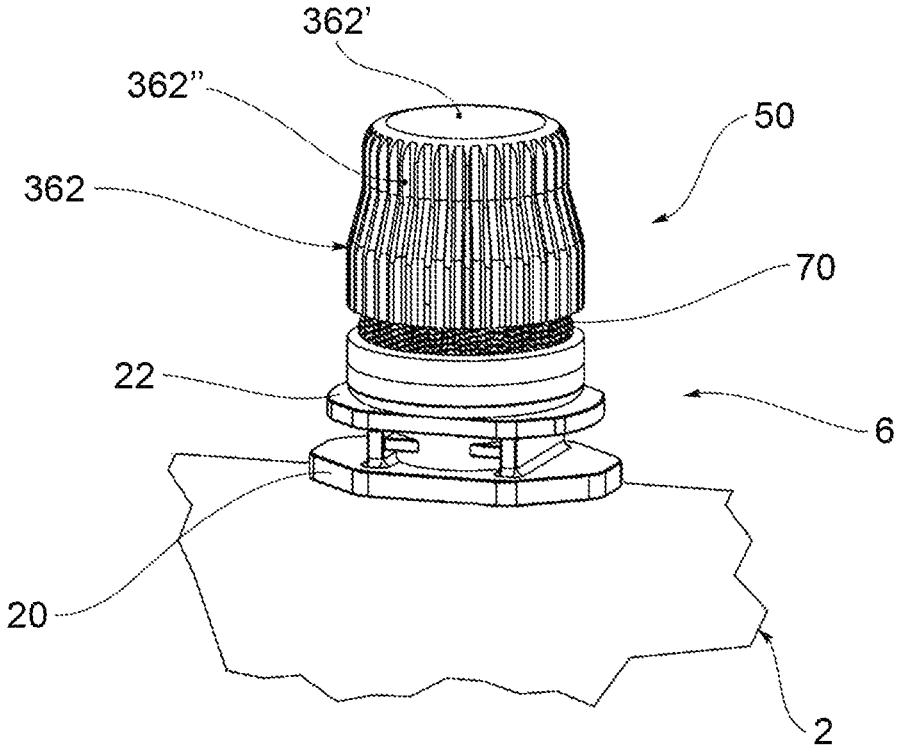
FIG. 20 shows the closure in FIG. 19 in a violate seal configuration.
Figure 21:
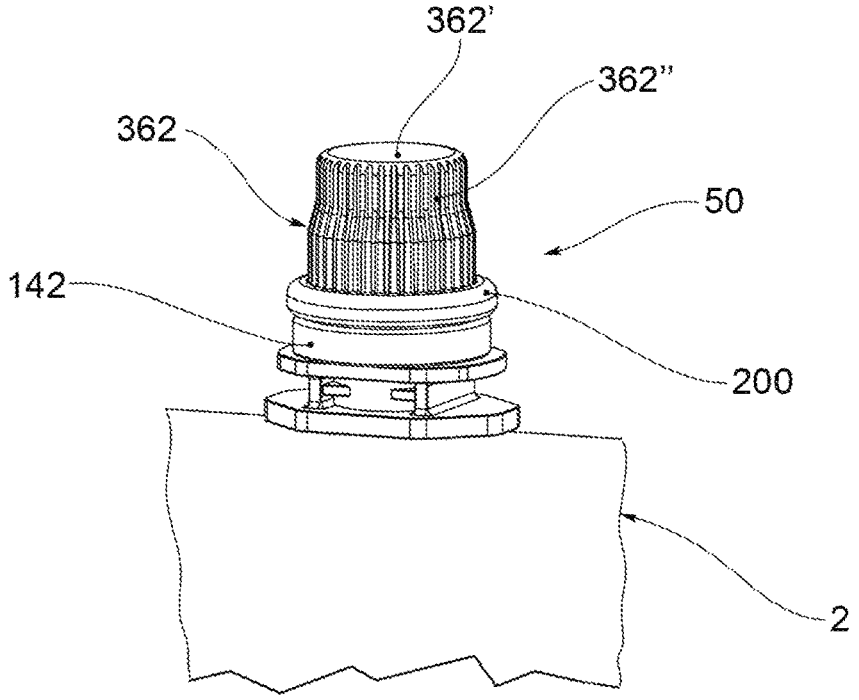
FIG. 21 shows a closure according to a further embodiment of the present invention, applied to the spout of a flexible packaging, in an inviolate seal configuration.
Figure 22:
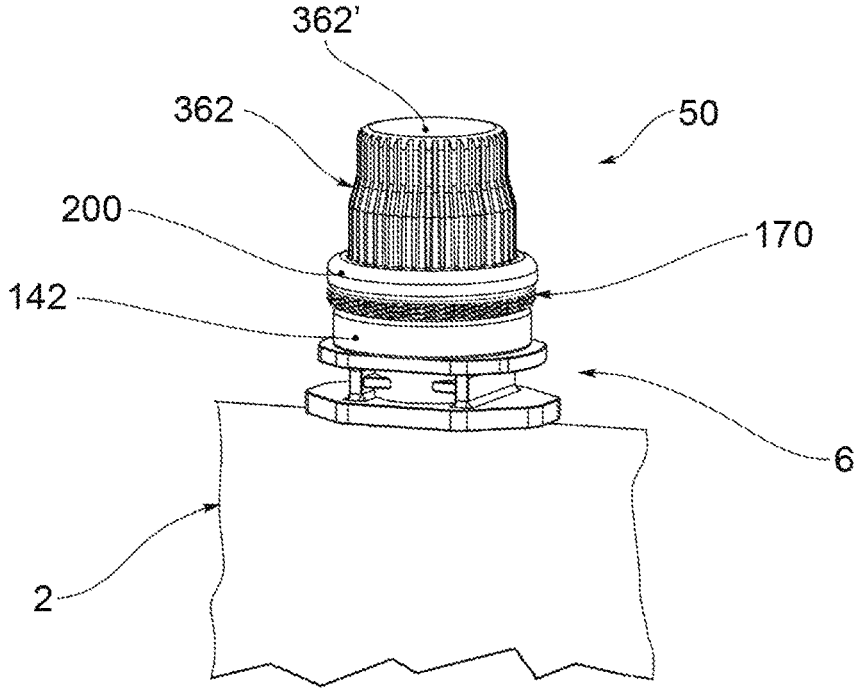
FIG. 22 shows the closure in FIG. 21 in a violate seal configuration.

According to further embodiments (FIGS. 19 to 22), the movable body 50 consists of a casing 362, provided with a bottom 362' and a side wall 362" projecting from bottom 362'.

According to an embodiment (FIGS. 19 and 20), cap is housed inside casing 362 and the tamper-evident band is provided with the structural and functional features described for the embodiment according to FIGS. 1 to 9.

According to a further embodiment (FIGS. 21 and 22), bottom 362' of casing 362 closes the mouth of the tubular body 10 of spout 6, the end portion of the side wall 362" constitutes the movable band 200 and the tamper-evident band is provided with the structural and functional features described for the embodiment according to FIGS. 10 to 18.

Innovatively, the closure with tamper-evident band according to the present invention overcomes the drawbacks mentioned with reference to the prior art, since the violation of the band is very evident.

In fact, the tamper-evident ring, especially if selected so as to have a colour contrasting with the other components of the closure, is immediately evident.

It is clear that a man skilled in the art may make changes to the closure described above in order to meet incidental needs, all falling within the scope of protection defined in the following claims.

The invention claimed is:

1. A tamper-evident closure attachable to a spout provided with a tubular body having an entry end and a dispensing end, the tubular body provided with a main annular abutment and comprising:

a tamper-evident band comprising a fixed band engaging the main abutment, the fixed band comprising a flared wall, the flared wall comprising a radially internal frusto-conical side surface converging toward the dispensing end;

a main cap body comprising a casing threadably attached to the spout;

the fixed band, in an inviolate condition, being connected to the main cap body through a weakened portion, the weakened portion joining a fixed edge of the fixed band and a movable edge of the main cap body;

a tamper-evident ring delimited by the fixed band and by the tubular body, the tamper-evident ring terminating with an annular tamper-evident edge, housed, with the tamper-evident band inviolate, in an inner compartment of the closure at least partially defined by the fixed band, the annular edge being hidden from view by the fixed band with the tamper-evident band inviolate, the tamper-evident ring comprising a tamper-evident wall having a frusto-conical outer surface parallel to the internal frusto-conical side surface of the fixed band flared wall;

wherein the weakened portion is tearable upon twisting of the closure from the spout and the tamper-evident ring is radially moveable outward from the inner compartment to separate the fixed edge of the fixed band and the moveable edge of the main cap body with the tamper-evident band violated; wherein the tamper-evident ring is integrally formed with the main cap body of the closure.

2. The closure according to claim 1, wherein said closure is snap-applicable to the spout.

3. The closure according to claim 2, wherein the fixed band has a free end bent radially internally or enlarged with respect to a remaining part of the fixed band, so that the fixed band is at least partially snap-received in a main recess formed in an undercut by said main abutment.

4. The closure according to claim 1, wherein the tamper-evident ring is received, with the tamper-evident band inviolate, in a compartment delimited by the fixed band, and is radially moveable from the compartment upon twisting of the closure.

5. The closure according to claim 1, wherein the tamper-evident ring is anchorable to the main abutment of the spout, thus preventing translation upon twisting of the closure.

6. The closure according to claim 5, wherein the main cap body comprises a movable band joined, with the tamper-evident band inviolate, to the fixed band through the weakened portion, the tamper-evident ring is received in a compartment delimited by the movable band and is radially moveable from the compartment upon twisting of the closure.

7. The closure according to claim 5, wherein the fixed band is limited in axial translation by a tamper-evident bushing of which the tamper-evident ring is part, the tamper-evident bushing being snap-engageable with the main abutment of the spout.

8. The closure according to claim 1, wherein with the tamper-evident band violated, the tamper-evident ring is axially intermediate the fixed edge and the moveable edge of the main cap body in the unsealed state.

9. The closure according to claim 1, wherein the annular abutment comprises a flared outer surface.

10. The closure according to claim 1, the weakened portion comprising an annular notch formed in an outer surface of the fixed band and projecting radially inward.

11. The closure according to claim 1, wherein the tamper-evident ring is delimited radially outwardly by the fixed band and is delimited radially inwardly by the tubular body.

12. The closure according to claim 1, wherein the annular tamper-evident edge of the tamper-evident ring is a visible portion of the part of the tamper-evident ring axially intermediate the fixed edge and the movable edge, with the tamper-evident band violated.

* * * * *